United States Patent [19]

Brooks

[11] Patent Number: 4,729,810

[45] Date of Patent: Mar. 8, 1988

[54] CARPET TAPE DISPENSER

[76] Inventor: Ronald H. Brooks, 293 Nepean Highway, Edithvale, Victoria 3196, Australia

[21] Appl. No.: 930,284

[22] PCT Filed: Feb. 7, 1986

[86] Pct. No.: PCT/AU86/00029

§ 371 Date: Oct. 7, 1986

§ 102(e) Date: Oct. 3, 1986

[87] Pct Pub. No.: WO86/04568

Pct Pub. Date: Aug. 14, 1986

[30] Foreign Application Priority Data

Feb. 8, 1985 [AU] Australia ..... PG9208

[51] Int. Cl.[4] ..... B29C 65/50; B32B 35/00

[52] U.S. Cl. ..... 156/391; 156/304.4; 156/505; 156/545; 156/577; 156/579

[58] Field of Search ..... 156/391, 304.4, 304.7, 156/505, 574, 577, 579, 152, 523, 527, 545

[56] References Cited

U.S. PATENT DOCUMENTS 3,138,512 6/1964 Partin ..... 156/523
3,326,738 6/1967 McLaughlin ..... 156/577
3,574,042 4/1971 McMullen ..... 156/574
3,619,333 11/1971 Meader ..... 156/505
3,725,182 4/1973 Regan ..... 156/527
3,927,298 12/1975 Prater ..... 156/391

FOREIGN PATENT DOCUMENTS 1192259 5/1970 United Kingdom ..... 156/304.4

*Primary Examiner*—Michael Wityshyn
*Attorney, Agent, or Firm*—Shlesinger Arkwright & Garvey

[57] ABSTRACT

A carpet tape dispenser has a main frame carried by divergent legs and runners. A roll of carpet seaming tape is rotatably mounted on a stub extending transversely from a frame member fixed to the main frame. A pair of carpet separating arms extend below the main frame, the arms diverging away from the main frame. A tape guide which is carried by and extends below the main frame is located between the arms. A handle is pivotally mounted to the main frame so that the dispenser can be drawn along carpet pieces to be seamed with the edges being separated by the arms to allow tape to engage beneath the carpet pieces.

15 Claims, 4 Drawing Figures

CARPET TAPE DISPENSER

BACKGROUND OF THE INVENTION

This invention relates to a tape dispenser and relates particularly to a dispenser for carpet seaming tape used in the formation of seams between opposed edges of carpet pieces to be joined.

Carpet seams are commonly formed using a carpet seaming tape which is caused to adhere to the opposed edges of the carpet pieces to be joined. Several different types of carpet seaming tape are used, depending on the method adopted for causing the tape to adhere to the backing of the carpet pieces. One form of tape comprises a backing material, reinforcing material and a heat softenable adhesive, the adhesive being softened, or melted, by a heated iron passed along the top of the tape whereafter the edge portions of the carpet pieces to be joined are pressed onto the melted adhesive which is allowed to cure or harden by cooling.

In another form of tape, at least one electrically conducting heating element is incorporated in the tape and the adhesive is softened by electrically heating the heating element, such as is described in Australian Pat. No. 529,440.

It has been common practice up until now to locate carpet seaming tape beneath the edge portions of the carpet pieces to be joined by lifting those edge portions and physically placing the tape in position. The tape is often provided with a centre guideline to assist in locating the tape centrally beneath the seam to be formed. However, it is often difficult to accurately locate the tape in position, and the proper location and positioning of the tape can be time consuming.

It is therefore desirable to provide apparatus which will assist in locating a carpet seaming tape beneath the edge portions of the carpet pieces to be joined.

It is also desirable to provide tape dispensing apparatus which is of relatively simple construction and which can dispense tape from a roll thereof to the proper location beneath the edge portions of the carpet pieces.

SUMMARY OF THE INVENTION

According to one aspect of the present invention there is provided a carpet seaming tape dispenser comprising a support frame having a pair of downwardly and outwardly extending leg means, tape carrying means to support a roll of tape, handle means, carpet edge separating means disposed between said leg means, and guide means to guide tape from said roll to beneath separated edges of carpet to be joined.

In one particular form of the invention, the leg means comprise a pair of runners carried on legs extending downwardly from the suppport frame, the runners being adapted to rest on and be drawn along the carpet pieces to be joined on either side of the seam to be formed. If desired, wheels or rollers may be incorporated on the runners to assist in movement of the dispenser along the carpet edge portions.

In the preferred form of the invention, the carpet edge separating means comprises a pair of downwardly and outwardly extending guides which are adapted to engage beneath the edge portions of the carpet pieces so that, as the dispenser is moved along the line of the intended seam, the guides act to lift and separate the opposed carpet edges. The spacing between the guides is such that a seaming tape can pass between the separated edges to be located beneath those edges when the dispenser is moved along the seam. The tape carrying means may include an upstanding frame member having a transversely extending stub on which is located the roll of tape. Releasable holding means is preferably provided to support the roll of tape on the stub.

The handle means may comprise a handle pivoted to the support frame and movable to enable the dispenser to be drawn or pushed along the carpet from either end.

In order that the invention will be more readily understood, one embodiment thereof will now be described with reference to the accompanying drawings.

DESCRIPTION OF THE PREFERRED EMBODIMENT

Figure 1:
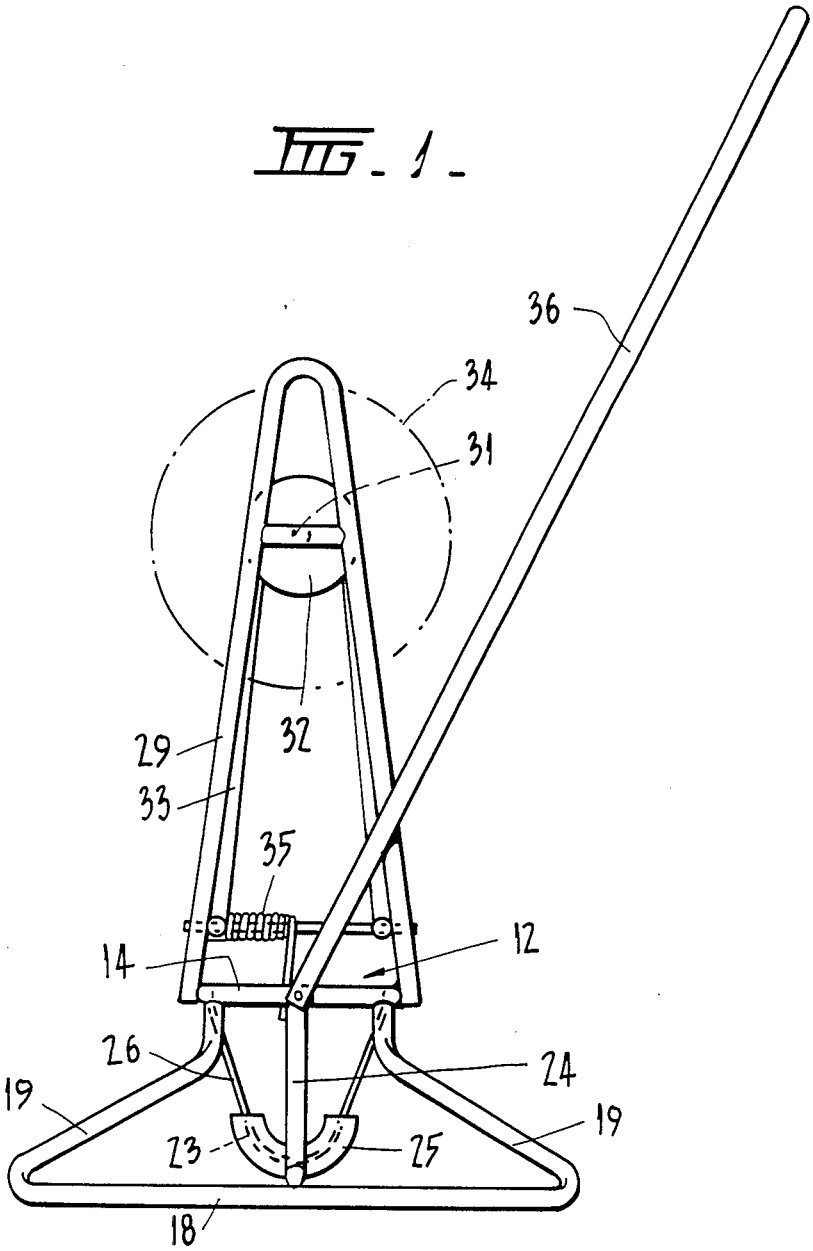
FIG. 1 is a side elevational view of a carpet tape dispenser in accordance with one embodiment of the invention.

Referring to the drawings the dispenser comprises a frame 12 which is substantially rectangular in plan and has two side members 14 and two end members 16. Gusset members 17 interconnect the side and end members 14 and 16.

A pair of runners 18 are carried by legs 19 extending downwardly and outwardly from the frame 12 so that the frame 12 can be supported above carpet pieces 21, the edge portions 22 of which are to be joined by a seaming tape.

Two guide bars 24 extend downwardly from the side members 14 each guide bar 24 being shaped to converge and then diverge outwardly at a similar angle to the diverging pairs of legs 19.

The frame 12 also carries a tape guide 26 which extends downwardly from the two end members 16 and has a curved lower part 23. An opposed pair of segments 25 are disposed on either side of the curved part 23 to assist in guiding tape from a roll to the carpet edges and to prevent the tape moving transversely off the guide 26.

Extending upwardly from one side of the frame 12 is a tape roll support member 29 of elongated "A" shape. The support member 29 is fixed to the frame 12. The support member 29 has a transversely extending stub 31 on which a roll of carpet seaming tape 34 can be engaged so as to be supported above the frame 12. In the preferred form of the invention, a boss 32 is rotatably mounted on the stub 31 to enable the roll of tape to freely rotate.

A holding frame 33 is pivoted to the support member 29 and is adapted to be moved adjacent the free end of the stub 31 to prevent inadvertent dislodgement of the roll of tape 34 therefrom. The holding frame 33 is biased into position by the biasing spring 35.

A handle 36 is pivotally mounted to the frame 12, the handle comprising a substantially U-shaped member having a transverse dimension substantially the same as that of the tape roll support member 29 and holding frame 33 so that the handle 36 can pivot over a roll of tape 34 carried by the dispenser.

Figure 2:
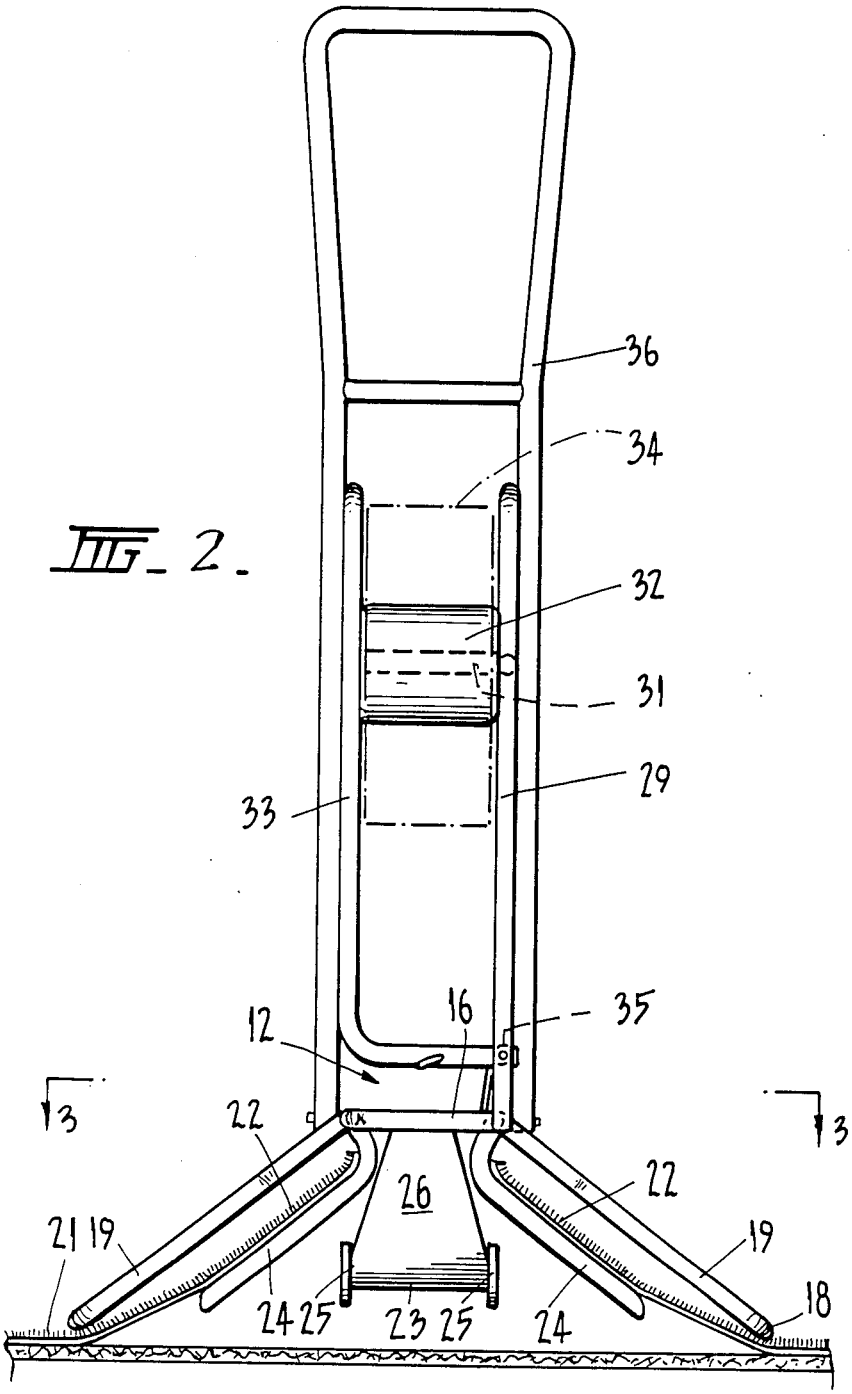
FIG. 2 is an end elevational view of the dispenser of the invention.
Figure 3:
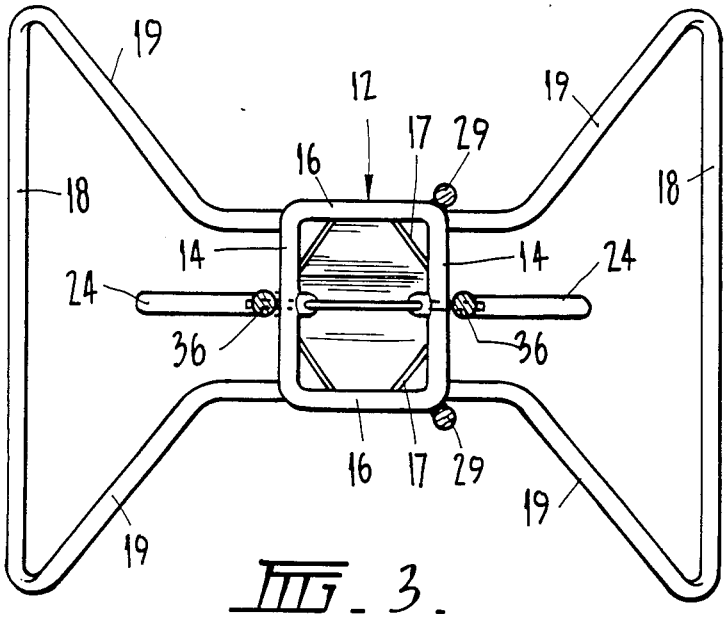
FIG. 3 is a plan view of the dispenser taken along the lines 2—2 of FIG. 2.
Figure 4:
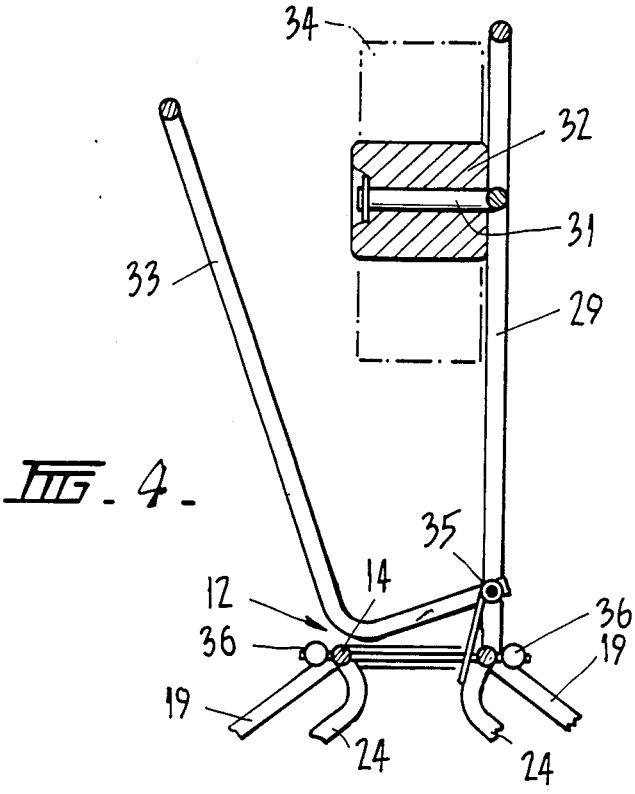
FIG. 4 is a cross-sectional detail view of part of the support frame.

In use, the dispenser is located at one end of the seam to be formed and tape is passed from the roll 34, passed one of the frame end members 16 and beneath tape guide 26. The end of the tape is secured adjacent the end of the seam, and the edge portions 22 of the carpet pieces 21 are lifted and engaged behind the guide bars 24. The dispenser is thus positioned as indicated in FIG. 2.

The handle 36 is pivoted forwardly of the runners 18 and is drawn along the line of the seam with the runners 18 running on the surface of the carpet pieces 21. The tension on the tape causes the tape to unroll from the tape roll 34 and pass beneath the raised carpet edges 22 to be located therebeneath when those edges fall back into place. As the dispenser is moved along the line of the seam, the guide bars 24 progressively lift and separate the edge portions 22. The weight of the dispenser together with the weight of the tape roll ensure that the runners 18 remain in contact with the surface of the carpet pieces 21.

The pivoted handle 36 enables relatively simple movement of the dispenser along the carpet seam. When the operator and dispenser has reached the opposite end of the seam, the handle can be moved towards the opposite side of the dispenser so that it can be pushed against the wall to complete the tape laying process.

It will be appreciated that the apparatus of the invention may be modified to include other features which are thought desirable. Thus, the tape guide 26 may include a sleeve roller to facilitate movement of the tape from the roll to beneath the carpet edges.

Additional guides and/or guide rollers may be provided to assist in guiding the tape from the roll to its location beneath the carpet edges. Such guides or guide rollers may extend from the frame adjacent the tape guide 26.

Naturally, the angle, length and construction of the runners 18 may be varied as desired, and the shape and design of the tape guide 26 may also be varied, such as by including guide surfaces to provide a positive engagement beneath the edge portions 22 of the carpet pieces before they are lifted.

I claim:

1. A carpet seaming tape dispenser, comprising:

(a) a main frame;

(b) a pair of support legs diverging downwardly and away from said main frame;

(c) a tape roll support fixed to said main frame and extending upwardly from one side of said main frame;

(d) said tape roll support including a stub axle for carrying a roll of tape;

(e) a holding frame pivotally connected to said tape roll support;

(f) said holding frame including a retaining lever means and spring means, said spring means permits an operator to pivot said retaining lever means for allowing removal of a roll of tape;

(g) a pair of carpet edge separating arms secured to opposed sides of said main frame and extending downwardly and outwardly therefrom;

(h) a tape guide member secured to said main frame and having at least a portion thereof extending below said main frame;

(i) at least a portion of said pair of carpet edge separating arms extending substantially parallel to at least a portion of a corresponding support leg means; and (j) said tape dispenser being substantially symmetrical about a vertical plane transverse to the direction of movement of the tape dispenser for permitting an operator to dispense tape in two opposite directions.

2. A carpet seaming tape dispenser as in claim 1, wherein:

(a) said main frame is substantially rectangular in shape; and (b) each of said support leg means include a runner, said runners extend substantially parallel to each other.

3. A carpet seaming tape dispenser as in claim 1, wherein:

(a) said tape guide member is substantially arcuate in shape and extends substantially centrally below said main frame.

4. A carpet seaming tape dispenser as in claim 1, wherein:

(a) said tape dispenser includes a U-shaped handle pivoted substantially centrally on said main frame and movable to extend beyond either one end or the other end of said main frame.

5. A carpet seaming tape dispenser as in claim 1, wherein:

(a) said tape dispenser is substantially symmetrical about a vertical plane parallel to the direction of movement.

6. A carpet seaming tape dispenser as in claim 1, wherein:

(a) said carpet edge separating arms each include first and second portions;

(b) said first portions extend substantially parallel to at least a portion of a corresponding support leg means; and (c) said second portions extend substantially perpendicular to at least a portion of a corresponding support leg means.

7. A carpet seaming tape dispenser, comprising:

(a) a main frame;

(b) a pair of support legs diverging downwardly and away from said main frame;

(c) a tape roll support fixed to said main frame and extending upwardly from one side of said main frame;

(d) said tape roll support including a stub axle for carrying a roll of tape;

(e) a holding frame pivotally connected to said tape roll support and spring biased to a position adjacent the end of said stub axle to hold a roll of tape on said stub axle and pivotal away from said stub axle to allow removal of the roll of tape;

(f) a pair of carpet edge separating arms secured to said frame and extending downwardly and outwardly therefrom;

(g) a tape guide member secured to said main frame and having at least a portion thereof extending below said main frame;

(h) at least a portion of said pair of carpet edge separating arms extending substantially parallel to at least a portion of a corresponding support leg means;

(i) said tape dispenser being substantially symmetrical about a vertical plane transverse to the direction of movement of the tape dispenser for permitting an operator to dispense tape in two opposite directions; and (j) a U-shaped handle means pivoted substantially centrally on the sides of the main frame and movable to extend beyond either one end or the other end of said main frame.

8. A carpet seaming tape dispenser as in claim 7, wherein:

(a) said main frame is substantially rectangular in shape; and (b) said support legs each include a runner, said runners extend substantially parallel to each other.

9. A carpet seaming tape dispenser as in claim 7, wherein:

(a) said tape guide member is substantially arcuate in shape and extends substantially centrally below said main frame.

10. A carpet seaming tape dispenser as in claim 7, wherein:

(a) said holding frame includes a retaining lever means and a spring; said spring means permits an operator to pivot said retaining lever means for allowing removal of a roll of tape.

11. A carpet seaming tape dispenser as in claim 7, wherein:

(a) said carpet edge separating arms each include first and second portions;

(b) said first portions extend substantially parallel to at least a portion of a corresponding support leg means; and (c) said second portions extend substantially perpendicular to at least a portion of a corresponding support leg means.

12. A carpet seaming tape dispenser as in claim 7, wherein:

(a) said tape dispenser is substantially symmetrical about a vertical plane parallel to the direction of movement.

13. A carpet seaming tape dispenser, comprising:

(a) a main frame;

(b) a pair of support legs diverging downwardly and away from said main frame;

(c) a tape roll support fixed to said main frame;

(d) said tape roll support including means for carrying a roll of tape;

(e) a pair of carpet edge separating arms secured to opposed sides of said main frame;

(f) a tape guide member secured to said main frame and having at least a portion thereof extending below said main frame; and (g) said tape dispenser being substantially symmetrical about a vertical plane transverse to the direction of movement of the tape dispenser for permitting an operator to dispense tape in two opposite directions;

(h) handle means pivoted substantially centrally on the sides of the main frame and movable to extend beyond either one end or the other end of said main frame.

14. A carpet seaming tape dispenser as in claim 13, wherein:

(a) at least a portion of said pair of carpet edge separating arms extend substantially parallel to at least a portion of a corresponding support leg means.

15. A carpet seaming tape dispenser as in claim 13, wherein:

(a) said carpet edge separating arms each include first and second portions;

(b) said first portion extending substantially parallel to at least a portion of a corresponding support leg means; and (c) said second portions extend substantially parallel to at least a portion of a corresponding support leg means.

* * * * *